US008365369B1

(12) United States Patent
Fountoulakis

(10) Patent No.: US 8,365,369 B1
(45) Date of Patent: Feb. 5, 2013

(54) CLUTCH FOR PRECIOUS METAL EARRINGS

(76) Inventor: Marcos Fountoulakis, Cranston, RI (US)

( * ) Notice: Subject to any disclaimer, the term of this patent is extended or adjusted under 35 U.S.C. 154(b) by 0 days.

(21) Appl. No.: 13/449,723

(22) Filed: Apr. 18, 2012

(51) Int. Cl.
*A44C 7/00* (2006.01)

(52) U.S. Cl. ..... 24/705; 63/35

(58) Field of Classification Search ..... None
See application file for complete search history.

(56) References Cited

U.S. PATENT DOCUMENTS

| | | | | |
|---|---|---|---|---|
| 1,023,663 | A | 4/1912 | Kubicek | |
| 1,024,762 | A | 4/1912 | Anderson | |
| 1,035,694 | A | 8/1912 | Dieffenbacher | |
| 1,281,844 | A | 10/1918 | Roy | |
| 2,305,412 | A * | 12/1942 | Frolich Per K et al. | 425/43 |
| 3,187,751 | A | 6/1965 | Coren | |
| 4,501,050 | A | 2/1985 | Fountoulakis | |
| 4,630,453 | A * | 12/1986 | Burkett | 63/12 |
| 4,843,699 | A | 7/1989 | Seidman | |
| D435,233 | S | 12/2000 | Fountoulakis | |
| 7,174,610 | B2 | 2/2007 | Rissin et al. | |
| 2010/0162540 | A1 | 7/2010 | Rissin et al. | |
| 2011/0191991 | A1 | 8/2011 | Meneau | |

* cited by examiner

*Primary Examiner* — Jack W. Lavinder
(74) *Attorney, Agent, or Firm* — Salter & Michaelson

(57) ABSTRACT

A clutch for post earrings includes a housing which is open at one end thereof and has an aperture therethrough in the opposite end thereof, a cap member which is received on the open end of the housing and also has an aperture therethrough, and an insert of a resilient leaf member that includes a support piece captured between the housing flange and the cap member and a pair of leaves supported from the support piece. The leaves converge with respect to each other and are disposed in facing relationship for receiving a post therebetween. The post is receivable in the clutch so that it extends through the cap member and housing apertures and is received in frictional engagement between the leaves.

20 Claims, 7 Drawing Sheets

CLUTCH FOR PRECIOUS METAL EARRINGS

FIELD OF THE INVENTION

The present invention relates in general to earrings and pertains more particularly to a clutch for post earrings of the type worn on pierced ears.

BACKGROUND OF THE INVENTION

Post earrings have become extremely popular in recent years and are currently available in a wide range of styles. Most of the conventional post earrings currently available comprise a decorative ornament which is adapted to be worn on the front side of a pierced ear lobe, an elongated post which extends rearwardly from the ornament and is positionable so that it extends through the aperture or hole in the ear lobe, and an earring clutch which is detachably receivable on the post on the rear side of the ear lobe to prevent the post from being accidentally withdrawn from the aperture in the ear lobe. While a variety of types of clutches have heretofore been available for use in combination with post earrings, one particular type of clutch commonly known as a "bullet" clutch has proven to be popular with the more expensive post earrings. A conventional bullet clutch comprises a generally cylindrical housing which is open at one end thereof and has an aperture therethrough in the opposite end thereof, an insert which is received in the housing, and a metal cap which is received on the open end of the housing. A conventional "bullet" clutch is receivable on the post of an earring so that the post extends through the apertures in the cap and the housing so that the insert in the housing frictionally engages the post to releasably retain the clutch on the earring. While "bullet" clutches of this type have proven to be highly popular and relatively easy to use, they have also had disadvantages. Specifically, it has been found that conventional "bullet" clutches frequently become ineffective after several months because the silicone or rubber inserts used in clutches of this type tend to become hard and brittle, and therefore they become ineffective for frictionally grasping earring posts.

Another form of a clutch is disclosed in U.S. Pat. No. 4,501,050 which employs a housing which is open at one end thereof and preferably has an aperture therethrough in the opposite end thereof. A cap member is secured on the open end of the housing, the cap member having an aperture therethrough which is aligned with the aperture in the housing. A pair of resilient leaves extend inwardly in the housing from the cap member in integral relation therewith and in converging relation with respect to each other so that the leaves preferably meet in substantially face-to-face relation at a point which is spaced from the cap member. The clutch is receivable on the post of an earring so that the post extends through the aperture in the cap member, between the resilient leaves, and through the aperture in the housing. The leaves thus resiliently embrace the post to frictionally retain it in the clutch and thereby releasably secure the clutch on the earring.

However, even with a clutch design as disclosed in the '050 patent the clutch can become rather expensive to manufacture particularly when constructed of precious metal materials such as gold or silver.

Accordingly, it is an object of the present invention to provide a clutch for post earrings in which an improved insert is provided that enable the construction of a more inexpensive product.

Another object of the present invention is to provide an improved clutch for post earrings and particularly wherein the insert can be constructed of a base metal while the other clutch components are constructed of a precious metal.

BRIEF SUMMARY OF THE INVENTION

To accomplish the foregoing and other objects, features and advantages of the present invention there is provided a clutch for post earrings and the like comprising: a. a housing which is open at one end thereof and has an aperture through the opposite end thereof, said housing having a generally outwardly extending peripheral flange at the open end thereof; b. a cap member received on the open end of said housing, said cap member comprising a substantially circular main portion having a substantially centrally disposed aperture therethrough and a generally inwardly extending peripheral flange, said housing flange being captured between said cap member main portion and said cap member flange to secure said cap member to said housing; and c. a resilient leaf member that includes a support piece captured between said housing flange and said cap member and a pair of leaves supported from the support piece, said leaves extending toward the housing aperture, said leaves converging with respect to each other and substantially meeting in face-to-face relation for receiving a post therebetween, said post being receivable in said clutch so that it extends through said cap member and housing apertures and is received in frictional engagement between said leaves.

In accordance with other aspects of the present invention each of the leaves has substantially free terminal ends; each leaf includes a leaf base and a leaf contact; the support piece has a centrally disposed aperture that is in alignment with the housing and cap member aperture; wherein, for each leaf, said leaf base is formed as a reversed member having one side supported by the leaf member support piece and the other side thereof integral with said leaf contact; the reversed member included opposed arms having a gap therebetween; the leaves have elongated facing grooves which cooperate to define a trackway in said clutch which is substantially in alignment with said apertures for receiving and aligning an earring post between said leaves; and the housing and cap member are constructed of a precious metal and the resilient leaf member is constructed of a base metal material.

In an alternate embodiment features include each leaf being constructed as a partially circular leaf; the support piece having a central aperture and each leaf connects to the support piece at a location spaced from the aperture; and the leaves having a single contact point therebetween.

DESCRIPTION OF THE DRAWINGS

Other objects, features and advantages of the invention shall become apparent as the description thereof proceeds when considered in connection with the accompanying illustrative drawings. In the drawings which illustrate the best mode presently contemplated for carrying out the present invention.

DETAILED DESCRIPTION

Figure 1:
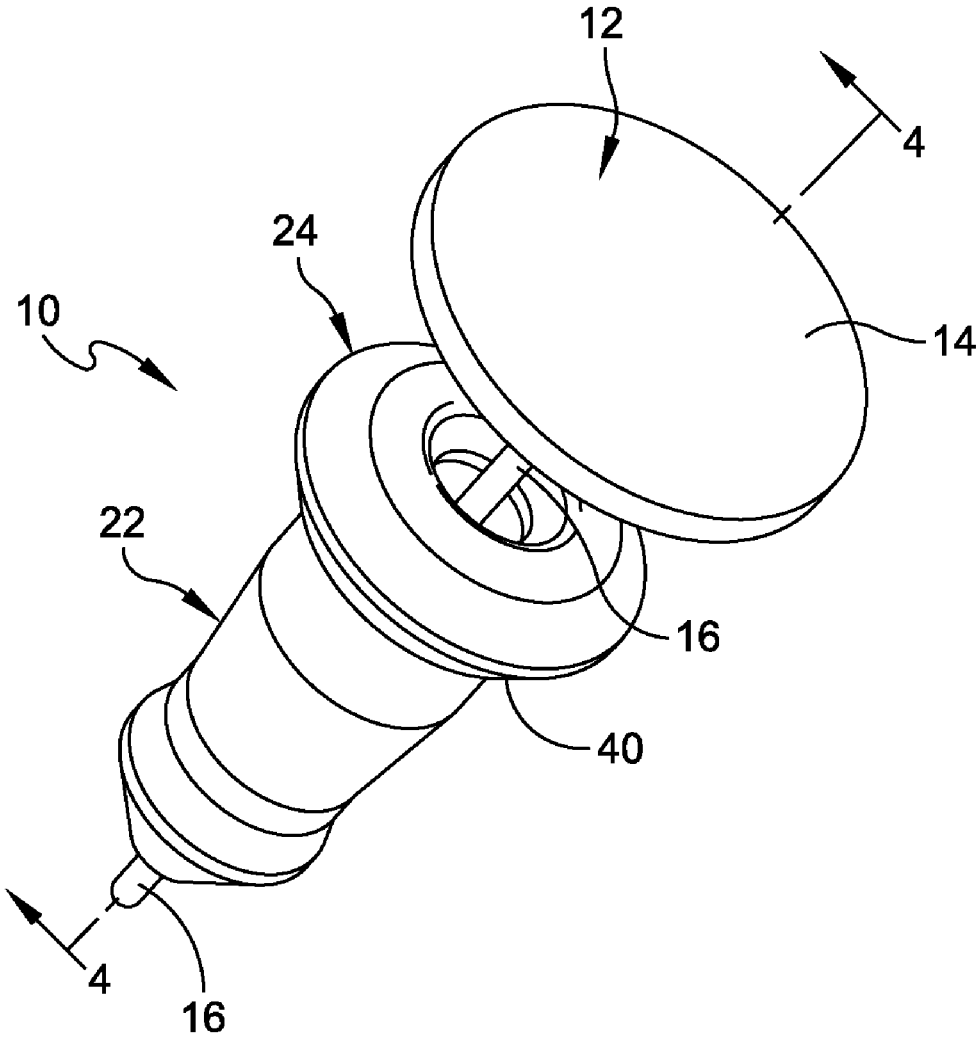
FIG. 1 is an enlarged perspective view of a clutch of the instant invention will a post earring received therein.
Figure 2:
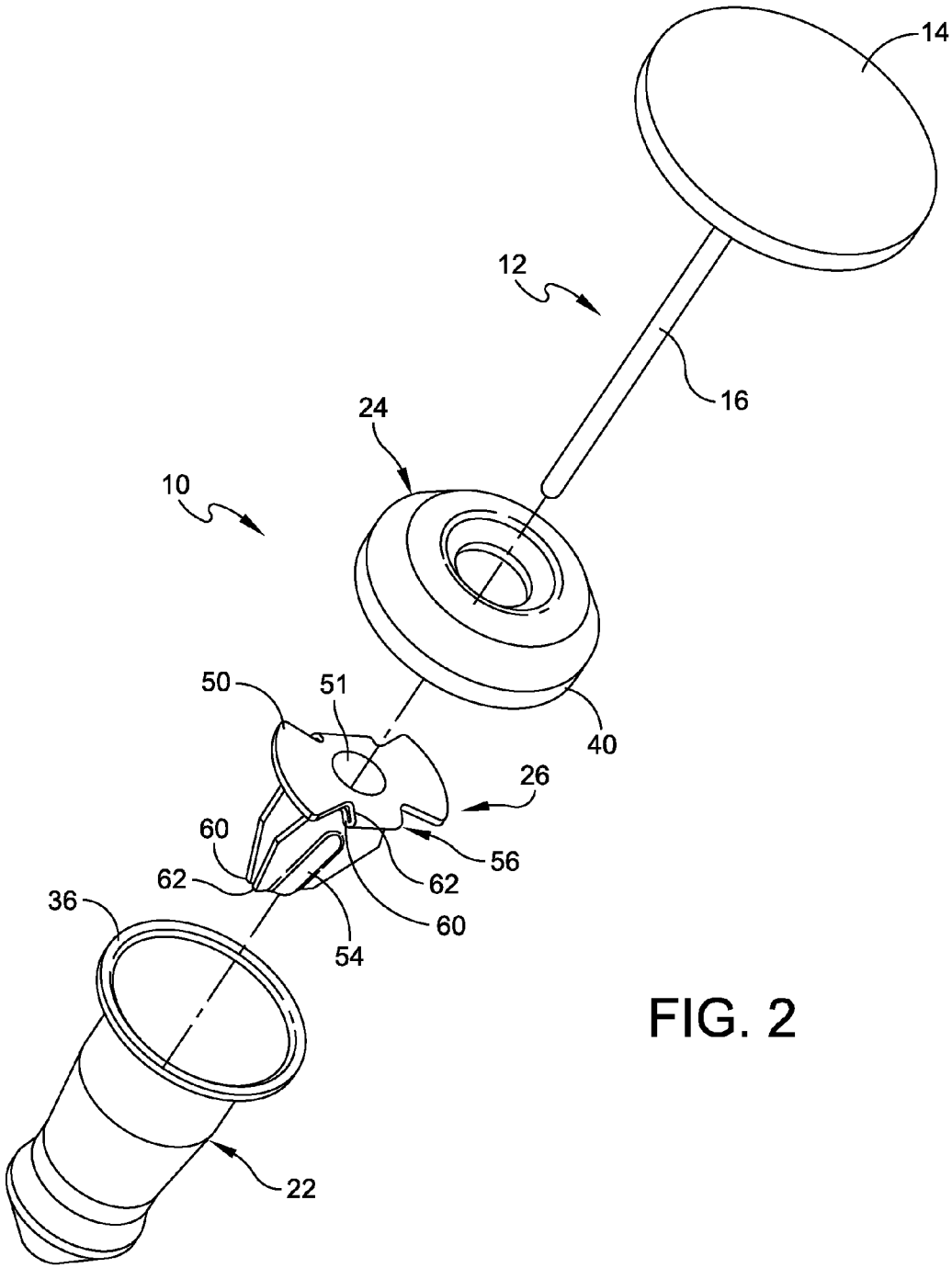
FIG. 2 is an enlarged exploded perspective view of the clutch and post earring.
Figure 3:
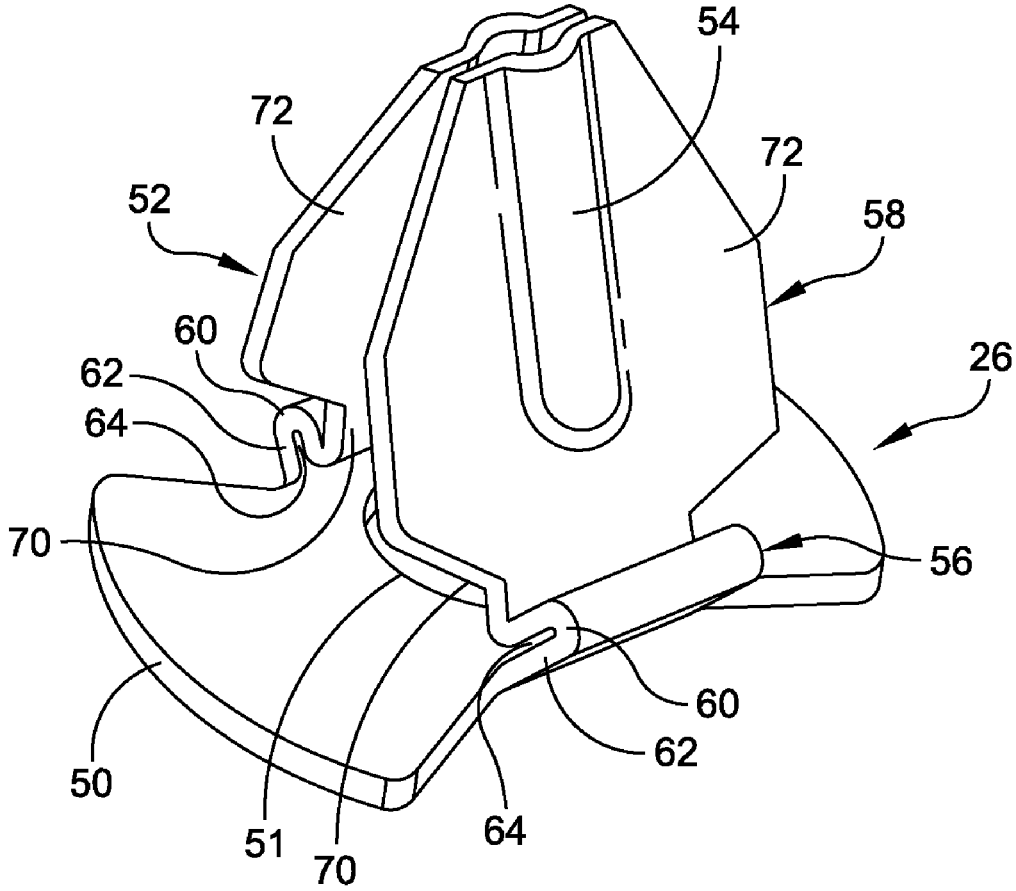
FIG. 3 is an even further enlarged perspective view of the cap member and leaves of the clutch of the present invention.
Figure 4:
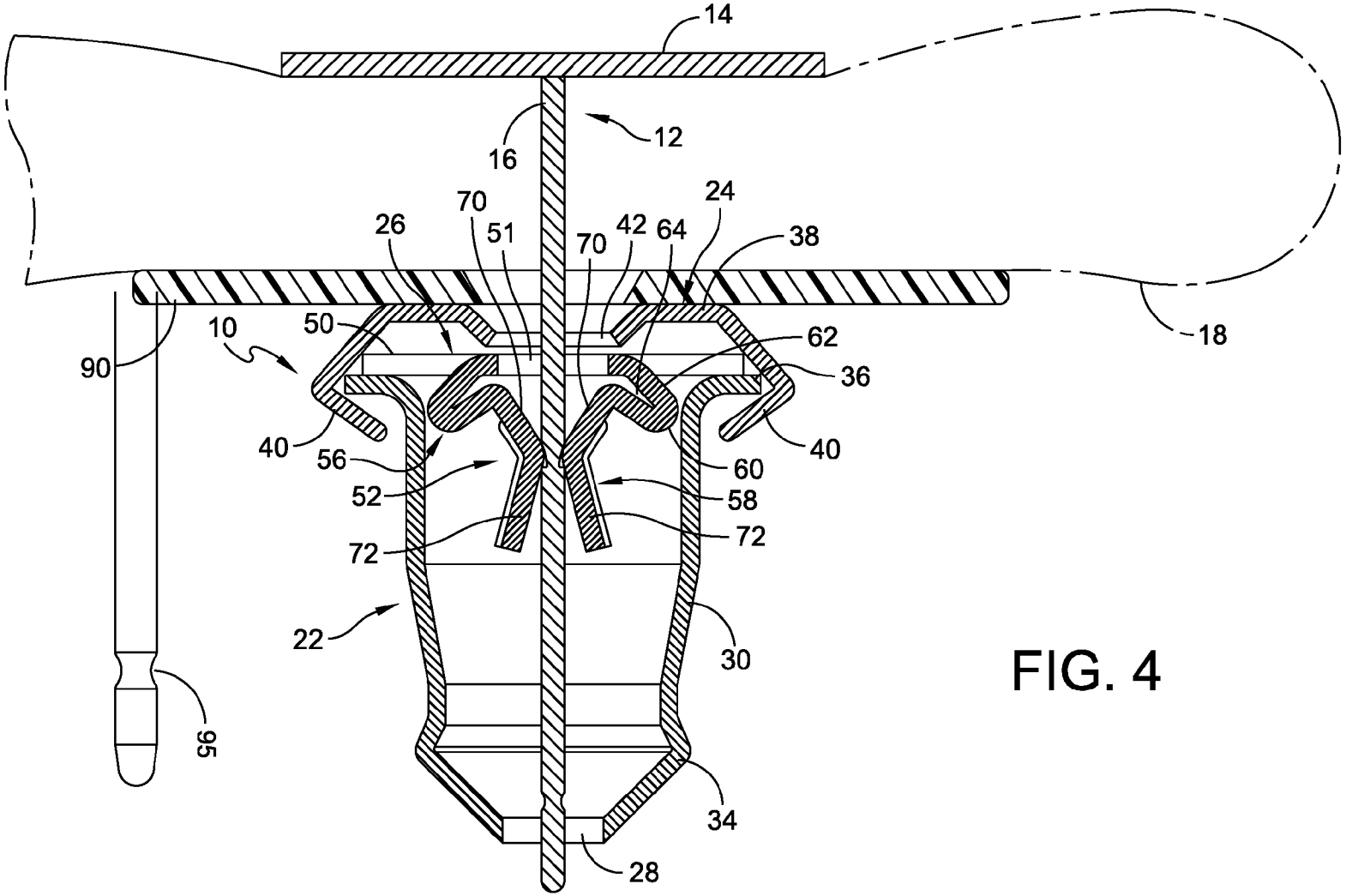
FIG. 4 is an enlarged sectional view taken along line 4-4 in FIG. 1.
Figure 5:
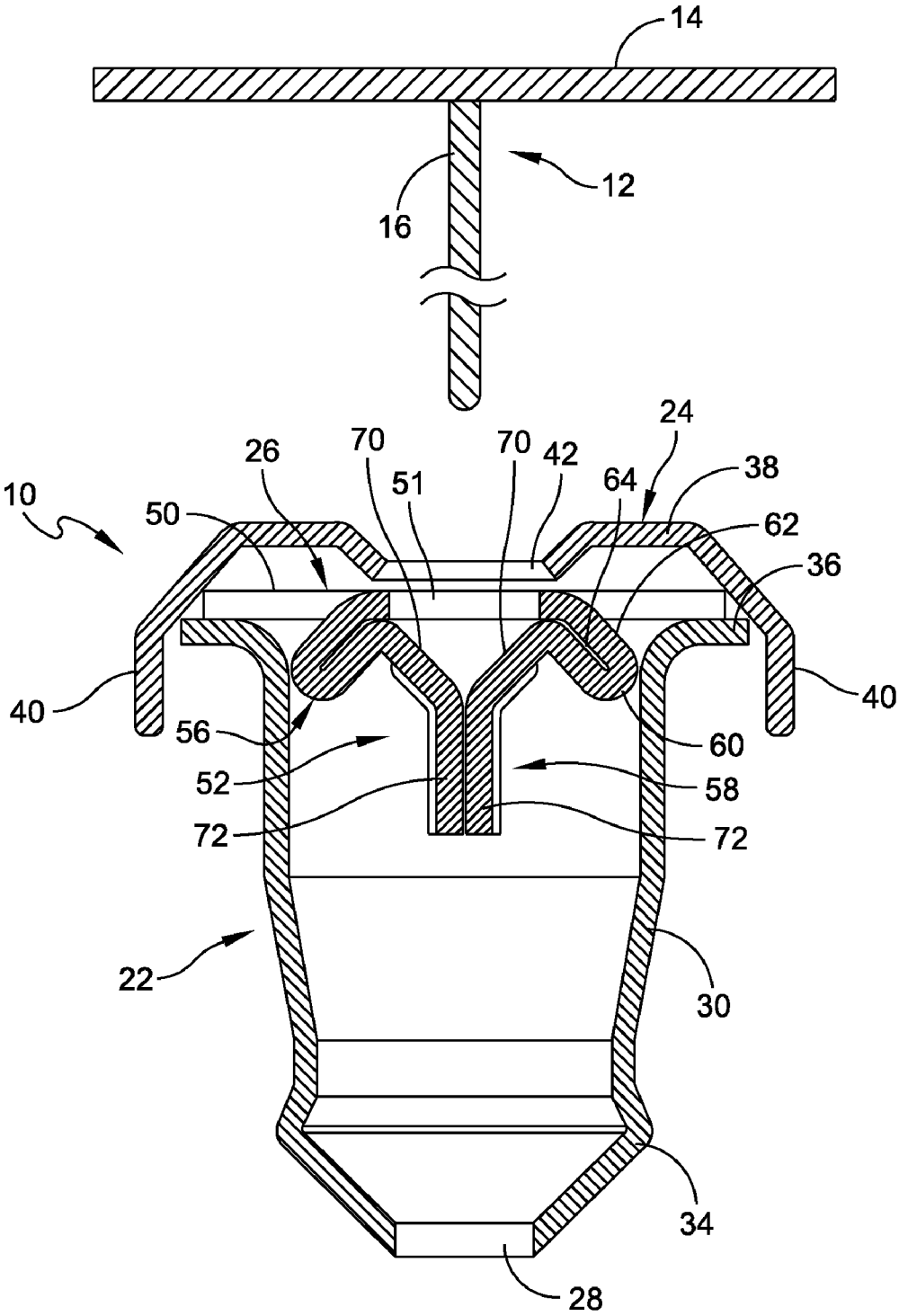
FIG. 5 is a sectional view like that shown in FIG. 4 but with the cap member not yet crimped.

Referring now to the drawing, the post-earring clutch of the present invention is illustrated and is generally indicated at 10 in FIGS. 1, 2, and 4. The clutch 10 is usable in combination with a post earring generally indicated at 12, of the type comprising a decorative ornament 14 and a post 16, and is operative for detachably retaining the earring 12 on a pierced ear of a wearer. Specifically, as illustrated in FIG. 4, when the earring 14 is received on a pierced ear lobe 18 of a wearer so that the ornament 14 is positioned on the front side of the ear lobe 18 and the post 16 extends through an aperture 20 in the ear lobe 18, the clutch 10 is located on the post 16 on the rear side of the ear lobe 18 for retaining the earring 12 on the ear lobe 18. See also FIG. 4 and the comfort disc 90 disposed between the cap member and ear lobe. The disc 90 is used to stabilize a larger earring onto the ear. This centers the earring and provides enhanced comfort.

Referring now to FIGS. 2 and 4, the clutch 10 comprises a tubular shell or housing generally indicated at 22, a cap member generally indicated at 24 which is secured on the housing 22, and a pair of resilient leaves which extend inwardly in converging relation into the housing 22 from the cap member 24. The housing 22 is preferably constructed of a suitable metal in a generally tubular cylindrical configuration which is open at one end thereof and has an aperture 28 that extends through the opposite end thereof. Preferably, the housing 22 is formed with a cylindrical main portion 30, and a terminal portion 34 in which the aperture 28 is formed. Provided in the housing 22 at the opposite end thereof from the terminal portion 34 is a peripheral flange 36 which extends outwardly from the main portion 30 and circumferentially around the open end of the housing 22 for receiving the cap member 24, as will hereinafter be more fully set forth.

As indicated previously, the clutch is comprised of, not only the housing 22, but also the cap member 24 received on the open end of said housing. The cap member 24 is also preferably formed with a substantially circular main portion 38 and a peripheral flange 40 which extends from the main portion 38, while the cap member 24 is dimensioned for being received on the housing 22 with the flange 36 of the housing 22 received within the flange 40. In the assembly of the cap member 24 to the housing 22 and as illustrated in FIG. 4, the flange 40 is preferably crimped into a substantially U-shaped or V-shaped configuration to capture the flange 36 of the housing 22 (as well as the insert 26) and thereby secure the cap member 24 thereto.

The main portion 38 of the cap member 24 may be formed in a slightly outwardly rounded configuration, so that the end of the clutch thereby defined is slightly convex. Extending through the cap member 24 in substantially the central portion thereof is a recessed aperture 42 which, when the cap member 24 is assembled on the housing 22, is substantially in alignment with the aperture 28 so that the apertures 28 and 42 cooperate to substantially define the central axis of the clutch 10. Thus, the cap member comprises a substantially circular main portion having a substantially centrally disposed aperture therethrough and a generally inwardly extending peripheral flange with the housing flange being captured between the cap member main portion and the cap member flange to secure said cap member to said housing.

The clutch 10 further is comprised of an insert illustrated as a resilient leaf member 26 that includes a support piece 50 captured between said housing flange 36 and said cap member and a pair of leaves 52 supported from the support piece. The support piece may be a single disc shaped member or two separate members, but in either case the support piece is captured and retained in place by the crimping action between the housing and cap member. This crimping action retains the insert in place without the need for any additional securing between the components. The support piece 50 also has an aperture 51 in alignment with apertures 28 and 42. The leaves 52 extend toward the housing aperture 28. The leaves converge with respect to each other and substantially meet in face-to-face relation for receiving a post 16 therebetween. The post is receivable in the clutch so that it extends through the cap member, insert and housing apertures and is received in frictional engagement between said leaves 52.

Each leaf includes a leaf base 56 and a leaf contact 58. The leaves 52 may have a partially arcuate surface, or as illustrated herein are each formed of a leaf base 56 illustrated as a reversed member having one side supported from the leaf member support piece 50 and the other side thereof integral with the leaf contact 58. The reversed member or base 56 include opposed arms 60, 62 having a slight gap 63 therebetween. The member 56 provides a spring effect to assist in providing a reasonably strong closure pressure against the earring post. Each of the leaf contacts may be considered as comprised of a first portion 70 which extends angularly from the member 56 at arm 60; and a second portion 72 that may be disposed substantially in parallel, extending from the first portion in an integral manner. This substantially straight portion 72 provides a substantial length along which a post can be captured. The arms 60, 62 extend in parallel as illustrated and extend generally in a direction that is orthogonal to the linear direction of portion 70. See angle A in FIG. 4. When the post is inserted, the combination of the direction of the arms 60, 62 and the angles of the portions 70, 72 provide a biasing force against the post. The gap 64 assists in allowing a flexure at that location while still effecting a strong closure bias.

Each of the leaf contacts preferably has an elongated facing groove 54 therein which define a trackway between the leaf contact, the trackway being substantially in alignment with the apertures 42 and 28. In this connection, it should be pointed out that it is important that the trackway defined by the grooves 54 is of smaller cross section than the post 16 so that when the post 16 is received therein the facing portions of the leaves are resiliently urged into embracing engagement with the post 16 to secure it in the clutch 10.

In use and operation of the clutch 10, the post 16 of the earring 12 is inserted through the hole or aperture in a pierced ear so that the ornament 14 is positioned against the front side of the ear lobe. The clutch 10 is then positioned on the post 16 by inserting the terminal end of the post 16 in the aperture 42. As the post 16 is further advanced into the clutch 10, it passes between the leaves 26 causing them to be resiliently separated slightly, and the post 16 is guided through the clutch 10 by the grooves 54 until the terminal end of the post 16 passes through the aperture 28. Normally, the clutch 10 is then further advanced on the post 16 until the main portion 38 of the cap member 24 is adjacent the rear side of the ear lobe. When the clutch 10 is positioned on an ear lobe in this manner, the leaf contacts 58 embrace the post 16 to maintain it in the clutch 10, whereby the earring 12 is maintained on the ear of the wearer.

It is seen, therefore, that the instant invention provides an effective clutch for post earrings which has specific advantages over the heretofore available clutches. The resilient leaves 26 resiliently embrace the post 16 so that the clutch 10 firmly and positively maintains the earring 12 on an ear of a wearer; and since the clutch 10 does not include a silicone or rubber insert for retaining the post 16, it can be used indefinitely without losing its effectiveness. Accordingly, for these reasons, as well as the other reasons hereinabove set forth, it is seen that the clutch 10 represents a significant advancement in the art which has substantial commercial merit.

In a preferred embodiment of the present invention the housing 22 and cap member 24 are constructed of a precious metal such as silver, gold or platinum. On the other hand because the insert 26 is a separate component that is only crimped in place it can be constructed of a less expensive base metal such as iron, nickel, lead or zinc.

Figure 7:
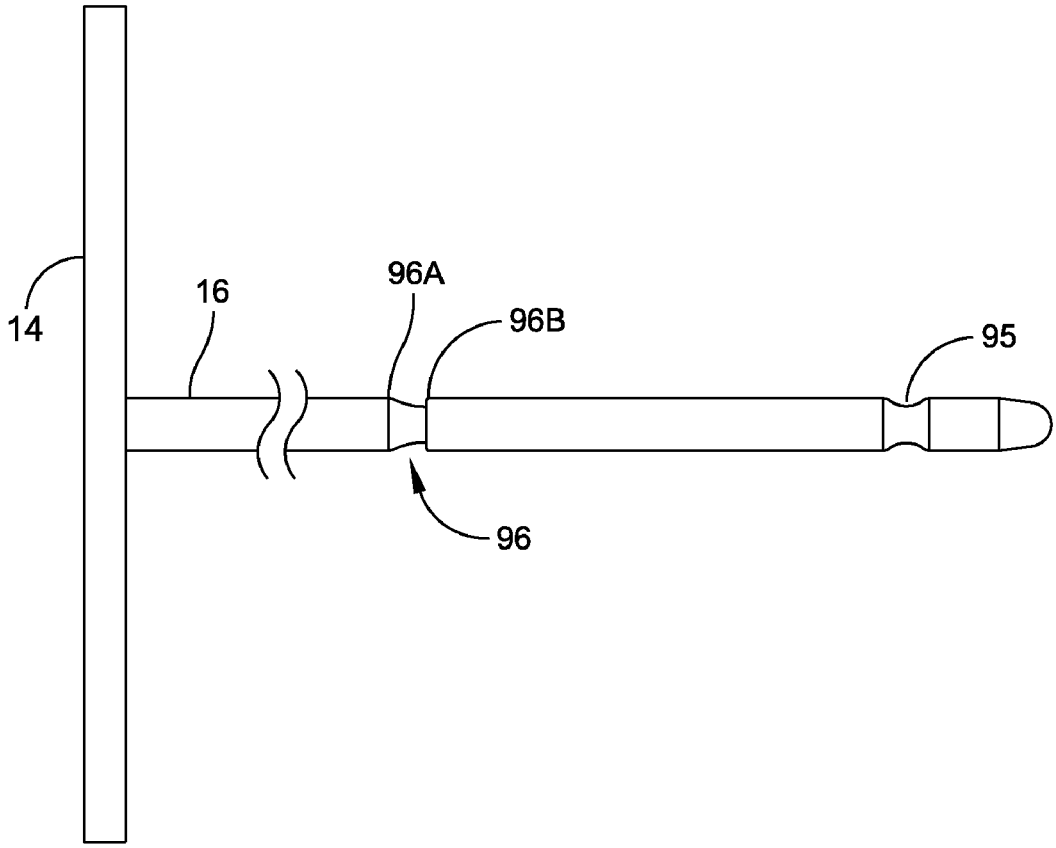
FIG. 7 is a side elevation view of the post earring with an alternate construction.

In FIG. 7 the post 16 is also shown having the conventional circular groove 95 adjacent to its distal end. In accordance with the present invention there is also added a locking groove 96. This is constructed with a taper starting at one end 96A and a substantially right angle step at end 96B. This step at 96B assists in essentially locking the bullet clutch 10 at the position illustrated in FIGS. 4 and 7 wherein the spring arms of the clutch 10 engage the locking groove 96. The sharp right angle edge 96A inhibits removal of the bullet clutch from the post 16. Although a groove and step arrangement are illustrated in FIGS. 4 and 7, it is understood that other post configurations may also be used to engage the clutch. For the most part, these other post configurations would include at least a single distal annular groove.

Figure 6:
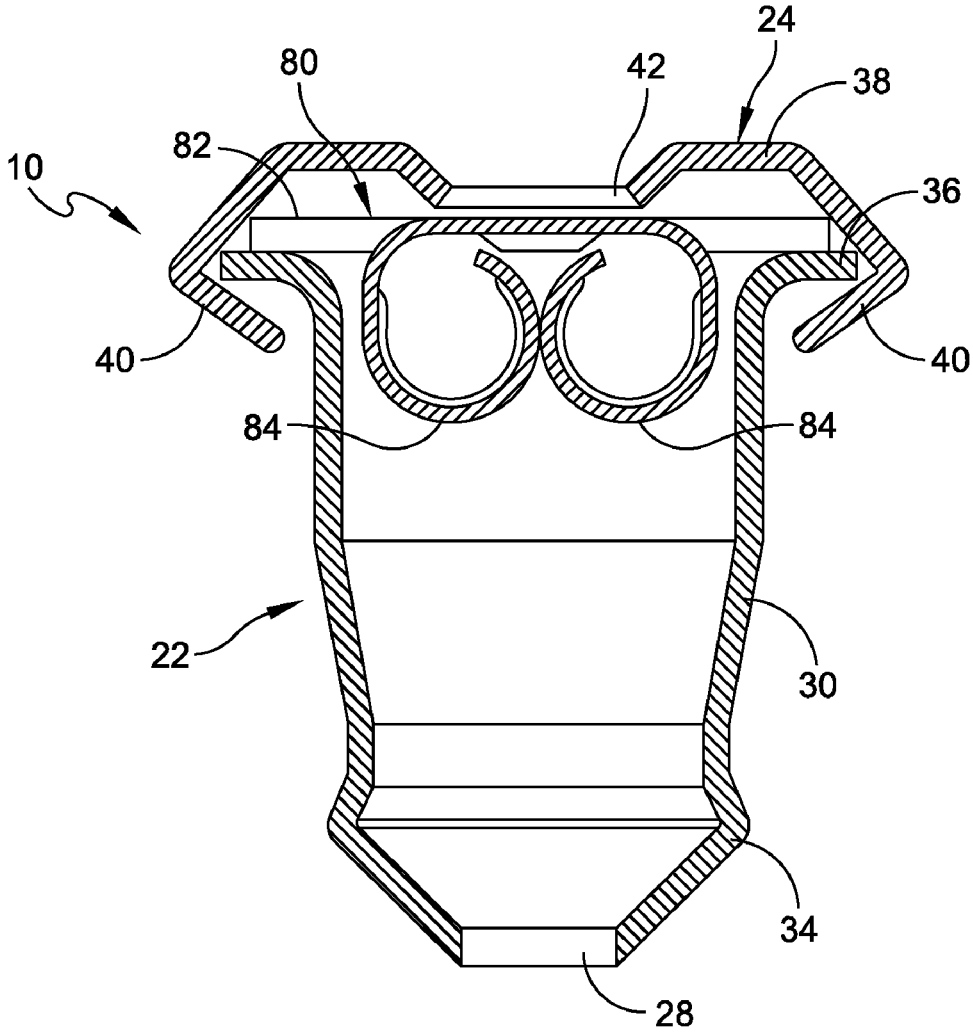
FIG. 6 is a sectional view of an alternate embodiment having circular leaves.

Reference is now made to an alternate embodiment of the present invention illustrated in FIG. 6 wherein the leaves are of generally circular configuration. In FIG. 6 the components such as the housing 22 may be the same as in the previous embodiments described herein. This also includes the cap member 24. Each of these members has respective apertures 28 and 42. The insert 80 is illustrated as crimped in place between the flanges 36 and 40 as in the previous embodiment. The insert 80 includes a support piece 82 captured between said housing flange 36 and said cap member and a pair of leaves 84 supported from the support piece. The support piece may be a single disc shaped member or two separate members, but in either case the support piece is captured and retained in place by the crimping action between the housing and cap member. This crimping action retains the insert in place without the need for any additional securing between the components. The support piece 80 also has an aperture in alignment with apertures 28 and 42. The leaves 84 extend toward the housing aperture 28. The leaves converge with respect to each other and substantially meet in face-to-face relation for receiving a post 16 therebetween. The post is receivable in the clutch so that it extends through the cap member, insert and housing apertures and is received in frictional engagement between said leaves 84. In this embodiment the leaves 84 are circular in construction and are supported from the support piece 82 spaced from the central aperture in the support piece so that the support location is sort of on the outboard side. The partially circular leaves then extend toward each other as illustrated and at the central axis of the clutch they contact essentially at a single contact point.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A clutch for post earrings and the like comprising:

a. a housing which is open at one end thereof and has an aperture through the opposite end thereof, said housing having a generally outwardly extending peripheral flange at the open end thereof;

b. a cap member received on the open end of said housing, said cap member comprising a substantially circular main portion having a substantially centrally disposed aperture therethrough and a generally inwardly extending peripheral flange, said housing flange being captured between said cap member main portion and said cap member flange to secure said cap member to said housing; and c. a resilient leaf member that includes a support piece captured between said housing flange and said cap member and a pair of leaves supported from the support piece, said leaves extending toward the housing aperture, said leaves converging with respect to each other and substantially meeting in face-to-face relation for receiving a post therebetween, said post being receivable in said clutch so that it extends through said cap member and housing apertures and is received in frictional engagement between said leaves, wherein the resilient leaf member support piece includes a substantially planar portion having a centrally disposed aperture that is in alignment with and spacedly disposed relative to the respective housing aperture and cap member aperture, wherein the housing and cap member are constructed of a precious metal and the resilient leaf member is constructed of a non-precious metal material; wherein said pair of leaves extend respectively at diametrically disposed locations from the substantially planar portion of the support piece; wherein each leave is integrally formed with the substantially planar portion of the support piece; wherein the diametrically disposed leaves each include a leaf contact and a leaf base that has one side thereof supported from the support piece and another side thereof integral with the leaf contact; and wherein each said leaf base includes a pair of connected arms that define a gap therebetween, that extend substantially in parallel to each other, and that have the respective arms integrally supported to the support piece and the leaf contact, whereby the arms are constructed and arranged to provide a spring effect that enables an enhanced closure pressure against the post.

2. The clutch of claim 1 wherein said leaves have substantially free terminal ends, and the arms of each leaf form a reverse spring having the arms interconnected at ends thereof to define the gap as a blind end gap.

3. The clutch of claim 1 wherein each leaf contact includes a first portion which extends angularly from the leaf base and a second portion integral with the first portion.

4. The clutch of claim 3 wherein both arms extend generally in a direction that is orthogonal to the first portion of the leaf contact.

5. The clutch of claim 3 wherein the gap is smaller that the width of either arm.

6. The clutch of claim 3 wherein the second portion of both said leaf contacts have elongated facing grooves which cooperate to define a trackway in said clutch which is substantially in alignment with said apertures for receiving and aligning an earring post between said leaves.

7. The clutch of claim 1 wherein the clutch receives a mounting post having a distal groove and spaced proximal thereof a right angle step.

8. The clutch of claim 1 wherein the substantially planar portion of the support piece includes diametrically disposed side wings that are captured between the housing flange and the cap member for retaining the resilient leaf member in place; wherein said diametrically disposed side wings extend along a first longitudinal axis that extends between respective wings; and wherein the diametrically disposed leaf bases extend along a second longitudinal axis that extends between respective leaf bases and that is orthogonal to the first longitudinal axis.

9. A clutch for post earrings and the like comprising:

a. a housing which is open at one end thereof and has an aperture through the opposite end thereof, said housing having a generally outwardly extending peripheral flange at the open end thereof;

b. a cap member received on the open end of said housing, said cap member comprising a substantially circular main portion having a substantially centrally disposed aperture therethrough and a generally inwardly extending peripheral flange, said housing flange being captured between said cap member main portion and said cap member flange to secure said cap member to said housing; and c. an insert comprised of a resilient leaf member that includes a support piece captured between said housing flange and said cap member and a pair of leaves supported from the support piece, said leaves extending toward the housing aperture, said leaves converging with respect to each other and disposed in facing relationship for receiving a post therebetween, said post being receivable in said clutch so that it extends through said cap member and housing apertures and is received in frictional engagement between said leaves, said insert also having an aperture in alignment with and spacedly disposed relative to the respective housing and cap member apertures, and said housing and cap member being constructed of a precious metal while the insert is constructed of a non-precious metal material; wherein said pair of leaves extend respectively at diametrically disposed locations from the substantially planar portion of the support piece; wherein each leave is integrally formed with the substantially planar portion of the support piece; wherein the substantially planar portion of the support piece includes diametrically disposed side wings that are captured between the housing flange and the cap member for retaining the resilient leaf member in place: wherein the diametrically disposed leaves each include a leaf contact and a leaf base that has one side thereof supported from the support piece and another side thereof integral with the leaf contact; wherein said diametrically disposed side wings extend along a first longitudinal axis that extends between respective wings; and wherein the diametrically disposed leaf bases extend along a second longitudinal axis that extends between respective leaf bases and that is orthogonal to the first longitudinal axis.

10. The clutch of claim 9 wherein said leaves have substantially free terminal ends.

11. The clutch of claim 9 wherein each said leaf base includes a pair of connected arms that define a gap therebetween.

12. The clutch of claim 11 wherein the support piece aperture, as well as the housing and cap member apertures are all of substantially the same size.

13. The clutch of claim 9 wherein, for each leaf, said leaf base is formed as a reversed member having one side supported by the leaf member support piece and the other side thereof integral with said leaf contact.

14. The clutch of claim 13 wherein the reversed member included opposed arms having a gap therebetween.

15. The clutch of claim 9 wherein said leaves have elongated facing grooves which cooperate to define a trackway in said clutch which is substantially in alignment with said apertures for receiving and aligning an earring post between said leaves.

16. The clutch of claim 9 wherein the support piece aperture is disposed between the cap member aperture and the housing aperture.

17. The clutch of claim 9 wherein the leaf base includes a pair of adjacent disposed arms that both have a length that extends in substantially the same direction as the first axis.

18. The clutch of claim 9 wherein each said leaf base includes a pair of connected arms that define a gap therebetween, that extend substantially in parallel to each other, and that have the respective arms integrally supported to the support piece and the leaf contact, whereby the arms are constructed and arranged to provide a spring effect that enables an enhanced closure pressure against the post.

19. The clutch of claim 18 wherein each leaf contact includes a first portion which extends angularly from the leaf base and a second portion integral with the first portion, and both arms extend generally in a direction that is orthogonal to the first portion of the leaf contact.

20. The clutch of claim 9 wherein the clutch receives a mounting post having a distal groove and spaced proximal thereof a right angle step.

* * * * *